United States Patent [19]

Leiserson

[11] Patent Number: 4,463,789

[45] Date of Patent: Aug. 7, 1984

[54] VIDEO EQUIPMENT BAG

[76] Inventor: Steven G. Leiserson, 9190 Manor Dr., La Mesa, Calif. 92041

[21] Appl. No.: 409,003

[22] Filed: Aug. 17, 1982

[51] Int. Cl.[3] ..... A45C 11/38; B65D 30/22; A44B 19/28

[52] U.S. Cl. ..... 150/52 J; 150/34; 206/316; 206/810; 224/264

[58] Field of Search ..... 150/525, 42, 34; 206/316, 810; 224/264, 901; 24/205 R

[56] References Cited

U.S. PATENT DOCUMENTS

| | | | |
|---|---|---|---|
| 609,230 | 8/1898 | Haegelin | 150/34 X |
| 1,557,382 | 10/1925 | Sundback | 206/810 X |
| 1,962,594 | 6/1934 | Herrmann | 150/42 |
| 2,960,137 | 11/1960 | Lipsitz | 150/52 J |
| 3,536,237 | 10/1970 | Greenman | 224/264 X |
| 3,885,722 | 5/1975 | Robertson | 224/264 X |
| 3,900,926 | 8/1975 | Takahashi et al. | 24/205 R |
| 4,210,186 | 7/1980 | Belenson | 150/52 J |
| 4,260,004 | 4/1981 | Domke | 150/52 J X |
| 4,301,898 | 11/1981 | Plough et al. | 150/34 X |
| 4,330,073 | 5/1982 | Clark | 150/52 J X |

FOREIGN PATENT DOCUMENTS

| | | | |
|---|---|---|---|
| 959816 | 3/1957 | Fed. Rep. of Germany | 24/205 R |
| 1078868 | 3/1960 | Fed. Rep. of Germany | 150/52 J |
| 2397169 | 2/1979 | France | 150/42 |
| 527825 | 10/1940 | United Kingdom | 24/205 R |

*Primary Examiner*—William Price
*Assistant Examiner*—Sue A. Weaver
*Attorney, Agent, or Firm*—Charmasson & Holz

[57] ABSTRACT

An equipment bag is provided particularly designed for use with a video camera and characterized by an internal open-topped pouch generally semi-circularly shaped with a Velcro patch on one side which mates at any desirable position along another Velcro patch mounted on one or both of the internal surfaces of the sidewalls of the body of the bag, the pouch being intended to hold video accessories and ordinarily would lie inside the bag alongside the lens of the camera, which is narrower than the camera body. Other salient features include a specialized four-way opening zippered top, a tripod holder and a comfortable shoulder strap with a built-in shock cord feature.

2 Claims, 8 Drawing Figures

VIDEO EQUIPMENT BAG

BACKGROUND OF THE INVENTION

This invention is designed particularly for the protection of a video camera, although this case is designed for a somewhat smaller camera and can actually accommodate a wide variety of equipment such as still cameras and their accessories in a very convenient fashion.

Traditionally, camera cases for small cameras have been rigid-shelled and often the interior space is either too open, permitting the accessories to knock against one another in transit, or too dedicated, with too many pigeon holes for specific accessories. Other cases have so many pockets and pouches that are accessible through zippers from the exterior that for the casual photographer it may become difficult to remember where anything is.

There is a need, therefore, for a lightweight case particularly adapted for carrying a small video camera, but also adapted toward other types of delicate equipment, which combines equipment protection with internal open space and the flexibility provided by a movable internal pouch for accessories.

SUMMARY OF THE INVENTION

The instant bag meets the above-stated need by utilizing a relatively open bag composed of a foam sandwich, with the internal accessory bag being in the form of a pouch which is not only flexible to accommodate pieces of equipment externally of the pouch but is also movable to different positions within the bag by virtue of Velcro strips which line both sidewalls of the body of the bag which mate with the back of the pouch. With both the body of the bag and the pouch being flexible, a variety of pieces of equipment can be contained within the bag inasmuch as all of the structure will yield to conform to the particular shape of the equipment and accessories. At the same time, however, the foam sandwich construction of the bag and the pouch is very effective in protecting the equipment from impact from the outside, and protecting accessories and equipment from knocking into one another. An additional feature of the flexibility of the pouch particularly is that ordinarily it will conform somewhat to the smallest volume possible, so that it will hold pieces of video equipment together and not spaced apart as they would be in a rigid container so that they would knock together as they are jostled.

In order to fully accommodate different pieces of equipment and enable their extrication in a moment's notice, as is often necessary when one is looking for news stories, a special lid is incorporated on the body of the bag which by virtue of its zippered construction can be actually hinged open along a line above each of the sidewalls or the endwall to provide maximum speedy access from any angle to the equipment inside. Specialized tripod retaining structure and a shoulder strap are also featured in the invention.

DETAILED DESCRIPTION OF THE PREFERRED EMBODIMENT

Figure 1:
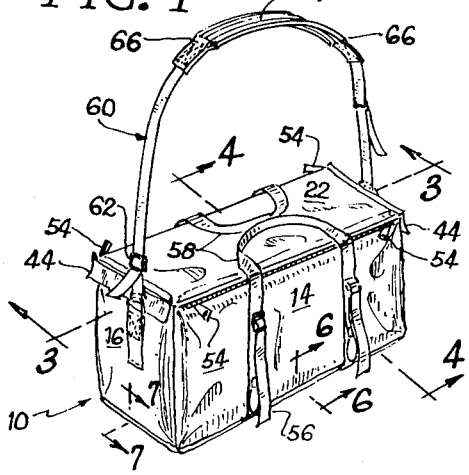
FIG. 1 is an elevation view of the bag.
Figure 6:
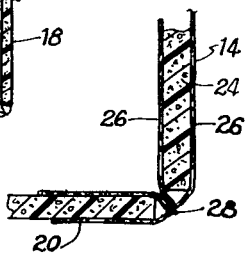
FIG. 6 is a section taken along line 6—6 of FIG. 1.
Figure 4:
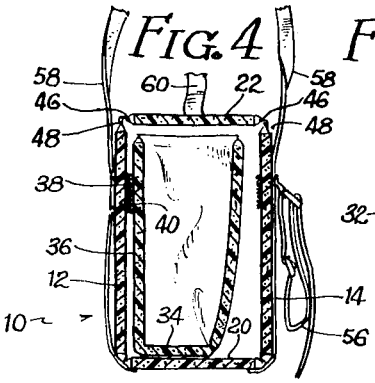
FIG. 4 is a section taken along line 4—4 of FIG. 1.
Figure 5:
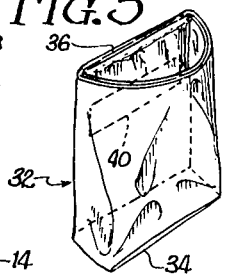
FIG. 5 is a perspective view of the pouch in isolation from the bag.
Figure 7:
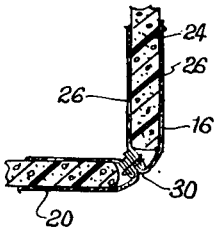
FIG. 7 is a section taken along line 7—7 of FIG. 1.

As shown in FIG. 1, the bag has a body portion 10 comprised of sidewalls 12 and 14, endwalls 16 and 18, a bottom 20, and a lid 22. The construction of all these panels utilizes a foam core panel 24, best shown in FIGS. 6 and 7, sandwiched between outer layers 26 of Nylon cloth or the equivalent. This construction makes the walls somewhat stiff and not loose and flappy, but also sufficiently flexible to yield to the contours of internal equipment and to fit better in confined spaces such as in aircraft or vehicles. As shown in FIG. 6, typically along a fold line the Nylon is stitched as at 28 along a discontinuity between foam panels. FIG. 7 illustrates the manner in which the bends are made when the Nylon cloth terminates, that is, the loose ends of the Nylon are sewn together as shown at 30. The same construction is used for the internal accessory pouch 32, which is generally semi-circularly shaped in its upper portion and merges into a rectangle to conform to the bottom panel 34, as is best seen in FIG. 5. A semi-circular upper portion of the bag defines a flat back, or generally flat back 36. The pouch mates to the interior of the body of the bag along the first elongated Velcro strip 38, which cooperates with the second Velcro strip 40 on the pouch. A third Velcro strip 42 is on the sidewall 14 in the preferred embodiment to optimize flexibility of utilization in the bag. The pouch can be moved anywhere within the bag, with the bottom 34 resting on the bottom 20 of the bag. Because the pouch extends virtually the entire height of the bag, it is open topped and relies on the lid 22 of the main body of the bag for its closure.

Figure 2:
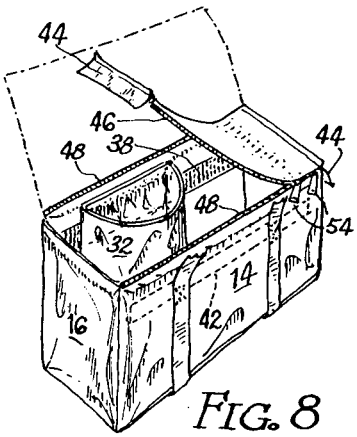
FIG. 2 is an elevation view showing the lid opened to one end, and opened to the side in phantom.
Figure 8:
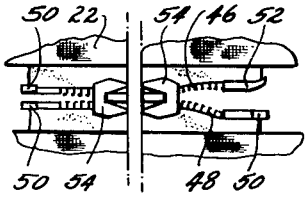
FIG. 8 is a detail illustrating the end of one of the zipper track pairs wherein the runners are retained on one track and released from the other to permit the opening of the lid to one side.
Figure 3:
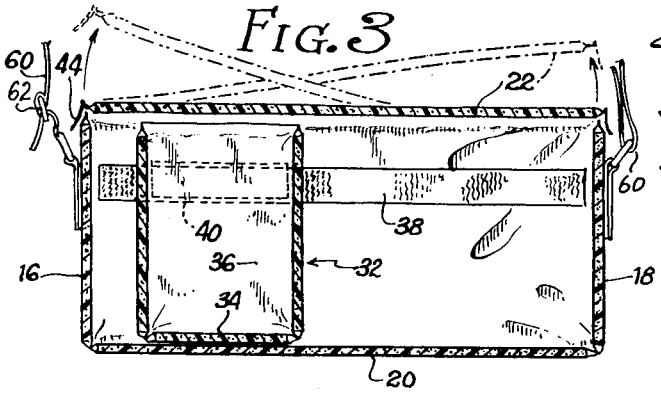
FIG. 3 is a section view illustrating the lid in place and also being hinged to either end in phantom, this section being taken along line 3—3 of FIG. 1.

The lid itself is provided with weather flaps 44 which also double as gripping flaps, and zipper tracks 46 along the sides of the lid. These zipper tracks are engaged to the corresponding zipper tracks 48 which differ from the upper zipper tracks in that they have a stop projection 50 which underlies the releasable end fitting 52 of the upper tracks so that when the zipper pairs 54 reach the end indicated in FIG. 8, the zippers remain on the lower track 48 and the lid comes free of the bag body, so that the lid can be swung to the opposite side along the top of the sidewall as shown in phantom in FIG. 2. The other end of the zipper track pair has a stop on both tracks, so that when the riders are moved to the other end, the lid cannot be freed but can only hinge back along the tops of the endwalls when the zippers on both sides of the body are at one end as shown in FIG. 2. This arrangement maximizes accessibility to the merchandise in the case and cooperates well with the movable pouch 32 so that wherever the pouch may be or wherever the main piece of equipment within the bag may be, there will be an easier way to get to them because of the flexible zipper arrangement.

Mounted on sidewall 14 are a pair of looped, buckled straps 56 which are useful to retain a tripod and can easily be cinched tight around a collapsed tripod by tugging the loose ends. Extending up from the same strap structure that defines the tripod straps 56 are loop handles 58 for use when the bag is hand-carried.

To enable the bag to be shoulder-carried, a strap 60 is provided which is adjustable at 62 and the center portion of which is made of a foam strip captured inside a cloth sleeve 64 and longitudinally sewn to define several scalloped ribs as can be seen in FIG. 1. Where the foam terminates, there are short pockets 66 within the sleeve beyond the ends of the foam which enable the rather stiff cloth material of the sleeve 64 to act in the nature of shock cords.

The bag is ideally suited for video cameras, and is also suited for many types of video equipment including static cameras wherein several lenses may be carried. Typically, there is either not enough room in camera bags, or the accessories one has do not fit the preassigned cavities of the bag. The instant bag, however, can accommodate a wide variety of cameras and accessories, and because it is so quickly accessible is ideal for both the camera buff and the video camera user.

While the preferred embodiment of the invention has been described, other modifications may be made thereto and other embodiments may be devised within the spirit of the invention and the scope of the appended claims.

What is claimed is:

1. An equipment bag comprising:

a box-shaped body with a bottom, sidewalls, endwalls and an openable lid;

a zipper track on the top edge of each sidewall;

a mating zipper track along each of the respective edges of said lid;

a pair of zipper riders mounted reversely to each other on each of said zipper track and mating track, and each rider being directed to fasten said tracks together when drawn away from the other rider;

means for stopping said riders at one end of each of said tracks;

means for stopping said riders at the other end of only one of said tracks with the adjacent track remaining free of any means for stopping said riders and being disengageable therefrom to allow the freeing of said lid along one entire edge so that the lid can be pivoted along the fastened tracks at the top of the other sidewall.

2. The bag claimed in claim 1 wherein said lid comprises a flap along each edge of said lid and overlapping the top portion of the respective endwall.

* * * * *